US005945240A

United States Patent [19]

Tashiro et al.

[11] Patent Number: 5,945,240

[45] Date of Patent: Aug. 31, 1999

[54] DIRECT DRAWING TYPE LITHOGRAPHIC PRINTING PLATE PRECURSOR

[75] Inventors: Hiroshi Tashiro; Eiichi Kato, both of Shizuoka, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/775,007

[22] Filed: Dec. 27, 1996

[30] Foreign Application Priority Data

Dec. 27, 1995 [JP] Japan ..... 7-341215

[51] Int. Cl.[6] ..... G03G 5/087

[52] U.S. Cl. ..... 430/49; 101/401.1; 428/148; 428/689

[58] Field of Search ..... 430/49; 101/401.1; 428/148, 689

[56] References Cited

U.S. PATENT DOCUMENTS

| | | | |
|---|---|---|---|
| 5,041,348 | 8/1991 | Kato et al. | 430/49 |
| 5,049,463 | 9/1991 | Kato et al. | 430/49 |
| 5,077,165 | 12/1991 | Kato et al. | 430/89 |
| 5,501,929 | 3/1996 | Kato et al. | 430/49 |
| 5,589,308 | 12/1996 | Kato et al. | 430/49 |
| 5,597,672 | 1/1997 | Kato | 430/49 |
| 5,624,777 | 4/1997 | Kato et al. | 430/96 |

*Primary Examiner*—Nam Nguyen
*Assistant Examiner*—Steven H. Ver Steeg
*Attorney, Agent, or Firm*—McAulay, Nissen, Goldberg, Kiel & Hand, LLP

[57] ABSTRACT

A direct drawing type lithographic printing plate precursor comprising a water-resistant support and an image receiving layer provided thereon, wherein a surface of the water-resistant support has the Bekk smoothness in the range of from 900 to 3,000 (second/10 cc) and the image receiving layer contains zinc oxide, a binder resin and a water-soluble organic compound having at least one acidic group selected from —$CO_2H$, —$SO_3H$ and —$PO_3H_2$, which is capable of forming a chelate compound with zinc oxide or a zinc ion. The direct drawing type lithographic printing plate precursor provides a lithographic printing plate which produces prints having a clear image without stains even when it is subjected to electrostatic transfer of a toner image formed by an electrophotographic copying machine.

6 Claims, No Drawings

DIRECT DRAWING TYPE LITHOGRAPHIC PRINTING PLATE PRECURSOR

FIELD OF THE INVENTION

The present invention relates to a direct drawing type lithographic printing plate precursor, and particularly to a direct drawing type lithographic printing plate precursor suitable for use in printing of a relatively small number of sheets (small-size printing).

BACKGROUND OF THE INVENTION

At present, direct drawing type lithographic printing plate precursors having an image receiving layer containing an inorganic pigment and a binder resin provided on a support are widely employed in offices. For plate making of such direct drawing type lithographic printing plate precursors, an electrophotographic copying machine for plain paper (PPC) has recently been used. Specifically, a toner image formed on an electrophotographic light-sensitive material by charging, exposing and developing is transferred electrostatically and fixed on the image receiving layer. The image-bearing printing plate precursor is then subjected to surface treatment with a desensitizing solution (a so-called "etching solution") to render the non-image areas hydrophilic, whereby a lithographic printing plate is produced.

SUMMARY OF THE INVENTION

An object of the present invention is to provide a direct drawing type lithographic printing plate precursor which is excellent in image reproducibility and prevention of background stains in the non-image portion by drawing an image through electrostatic transfer of a toner image onto its image receiving layer by way of a laser printer, etc., so as to provide prints having a clear image without stains.

Another object of the present invention is to provide a direct drawing type lithographic printing plate precursor exhibiting an excellent desensitizing property and providing a printing plate not only free from background stains over an entire surface but also free from dot-like stains.

A further object of the present invention is to provide a direct drawing type lithographic printing plate precursor which can produce prints having a clear image without stains even when the precursor is subjected to electrostatic transfer of a toner image formed by an electrophotographic copying machine in plate-making.

A still further object of the present invention is to provide a direct drawing type lithographic printing plate precursor which is free from a problem in that cuttings of fine lines and fine letters and unevenness such as white spots occur in prints obtained.

Other objects of the present invention will become apparent from the following description.

It has been found that these objects of the present invention are accomplished by a direct drawing type lithographic printing plate precursor comprising a water-resistant support and an image receiving layer provided thereon, wherein a surface of the water-resistant support has the Bekk smoothness in the range of from 900 to 3,000 (second/10 cc) and the image receiving layer contains zinc oxide, a binder resin and a water-soluble organic compound having at least one acidic group selected from —$CO_2H$, —$SO_3H$ and —$PO_3H_2$, which is capable of forming a chelate compound with zinc oxide or a zinc ion.

DETAILED DESCRIPTION OF THE INVENTION

The direct drawing type lithographic printing plate precursor of the present invention forms a good image without cutting in the image portion and free from stains in the non-image portion by plate-making, particularly by-the plate-making using a dry toner type electrophotographic copying machine or a copying machine of thermal transfer type, so that prints having a clear image without background stains can be obtained upon offset printing using the resulting printing plate which has been subjected to the desensitizing treatment.

A surface of the image receiving layer provided on the support having the Bekk smoothness of the above-described range is preferably adjusted to have the Bekk smoothness in the range of from 25 to 100 (second/10 cc), and more preferably from 30 to 80 (second/10 cc). A duplicated image formed on the image receiving layer is free from stains due to scattering of toner or adhesion of ink in the non-image portion and has sufficient adhesion of the toner and ink in the image portion, whereby reproducibility of fine lines and fine letters and uniformity in density of the solid image part can be improved.

On the contrary, when a conventional image receiving layer which does not contain the water-soluble organic compound having at least one acidic group selected from —$CO_2H$, —$SO_3H$ and —$PO_3H_2$, which is capable of forming a chelate compound with zinc oxide or a zinc ion (hereinafter simply referred to compound (A) sometimes) is used, stains occur in the non-image portion even if a surface of the image receiving layer side of a support has the Bekk smoothness in the above-described range.

Observation of the non-image portion of the two printing plate precursors described above after plate making by an optical microscope of 200 magnifications revealed that the number of adhesion of scattered toner per unit area was substantially the same but the size of the adhesion of scattered toner was markedly different from each other. Specifically, the number of large toner adhered having a size of not less than 15 $\mu$m observed on the printing plate precursor of the present invention is significantly decreased to not more than 50% that observed on the conventional printing plate precursor. Thus, the stains on the non-image portion are negligible and do not cause a problem in practical use in the present invention.

One main reason why the printing plate precursor of the present invention exhibits the excellent effect is believed to be due to the surface structure of the image receiving layer. More specifically, when examined a three-dimensional surface roughness measured by a feeler type surface roughness meter and observed the surface condition with SEM (scanning electron microscope), the image receiving layer of the present invention has high protrusions densely, as compared to a conventional receiving layer which does not contain the compound (A). The image receiving layer of the present invention preferably has an average surface center roughness (SRa) defined in ISO-468 in the range of from 1.3 to 3.5 $\mu$m, and an average wavelength (S$\lambda$a), which indicates the density of the surface roughness, of not more than 50 $\mu$m. More preferably, the S$\lambda$a is in a range of from 1.35 to 2.5 $\mu$m and the S$\lambda$a is not more than 45 $\mu$m. Because of the surface structure as described above, adhesion of the scattered toner to the non-image portion after plate-making by electrophotography and spreading of adhered toner particles during fixing can be prevented.

The direct drawing type lithographic printing plate precursor according to the present invention is also characterized in that the image receiving layer described above is provided on the water-resistant support having the Bekk smoothness in the range of from 900 to 3,000 (second/10 cc).

The Bekk smoothness is a value which indicates smoothness of a surface and can be measured by a Bekk smoothness tester as described in JIS P 8119. The measurement by the Bekk smoothness tester is performed by pressing a test piece on a circular glass plate having a hole at the center thereof and a highly smoothened surface under the definite pressure (1 $Kg/cm^2$) and determining a time necessary for the definite amount (10 cc) of air to pass between the test piece and the surface of glass plate under a reduced pressure.

The Bekk smoothness of the surface of water-resistant support is preferably from 1,000 to 3,000 (second/10 cc). The surface of water-resistant support means a surface on which the image receiving layer is directly provided, and means a surface of an underlayer or overcoat layer when the underlayer or overcoat layer is provided on the support as described hereinafter.

Using the water-resistant support having the highly smooth surface, the image receiving layer having the controlled surface structure described above is firmly maintained thereby further improving image qualities.

Moreover, when printing is conducted using a printing plate which is finally obtained by the desensitizing treatment of the image-bearing printing plate precursor, good prints having the image portion excellent in reproducibility of fine lines and fine letters and uniformity in density of the solid image part and little background stains which do not cause problems in practice in the non-image portion can be obtained.

On the contrary, when the image receiving layer according to the present invention provided on a support having the Bekk smoothness of less than 900 (second/10 cc) is used, uniformity of adhesion of toner and ink in the image portion is deteriorated and unevenness of image occurs in prints.

Now, the image receiving layer which can be used in the present invention will be described in more detail below.

The zinc oxide used is any of zinc oxide, zinc white, wet-type zinc white, and activated zinc white as commercially available, as described in "Shinban Ganryo Binran (New Edition of Pigment Handbook)", Nippon Ganryo Gijutsu Kyokai, ed., pp. 319, Kabushiki Kaisha Seibundo (1968).

Specifically, depending on the starting materials and production manners, zinc oxide is classified into two groups, those produced by a wet method and those produced by a dry method which are further subclassified into zinc oxide produced by French method (indirect method) and those produced by American method (direct method).

Suitable examples of zinc oxide are those commercially available from Seido Kagaku Kogyo K.K., Sakai Chemical Industry Co., Ltd., Hakusui Chemical Industries, Ltd., Honjo Chemical K.K., Toho Zinc Co., Ltd., Mitsui Mining & Smelting Co., Ltd., etc.

Zinc oxide grains obtained by the dry method generally have an average primary grain diameter of not more than 1.0 $\mu$m. On the other hand, those obtained by the wet method generally have an average primary grain diameter of not more than 0.1 $\mu$m.

The content of zinc oxide in the image receiving layer is generally from 80 to 90% by weight, preferably from 82 to 88% by weight.

The water-soluble organic compound having at least one acidic group selected from —$CO_2H$, —$SO_3H$ and —$PO_3H_2$, which is capable of forming a chelate compound with zinc oxide or a zinc ion (compound (A)) will be described below.

The compound (A) has a solubility in water (at 25° C. ) of at least 0.5% by weight, and preferably not less than 5% by weight. The compound (A) is not particularly limited in its structure as long as it fulfills the above-described physical property, and includes any of a low molecular weight compound and an oligomer and polymer (hereinafter-simply referred to as a polymer).

The content of compound (A) in the image receiving layer of the present invention is preferably in the range of from $1.0\times10^{-4}$ to $1.0\times10^{-1}$ mol per 100 g of zinc oxide. In such a range, the resulting printing plate provides good prints having a clear duplicated image in the image portion and no background stain in the non-image portion. The content of compound (A) is more preferably from $1.0\times10^{-4}$ to $5.0\times10^{-2}$ mol, particularly preferably from $2.0\times10^{-4}$ to $4.0\times10^{-2}$ mol per 100 g of zinc oxide.

Preferred suitable examples of the low molecular weight compound as compound (A) include inositol hexaphosphate (phytic acid), inositol hexaphosphate derivatives wherein a hydroxy group at the 1- or 4-position is inactivated as described, for example, in JP-A-53-83806, JP-A-53-83807, JP-A-53-109701, JP-A-53-127002, JP-A-53-127003 and JP-A-54-44901, and aliphatic carboxylic acids containing at least one polar group selected from a hydroxy group, a thiol group, an amino group, a carboxy group, a phosphonic acid group and a sulfonic acid group, which may have substituent (s) other than the polar group, for example, a halogen atom (e.g., fluorine, chlorine, bromine and iodine), an alkyl group having from 1 to 3 carbon atoms (e.g., methyl, ethyl and propyl), an alkoxy group having from 1 to 4 carbon atoms (e.g., methoxy, ethoxy, propoxy and butoxy), a cyano group, a formyl group, a carboxylic acid ester substituted with an alkyl group having from 1 to 4 carbon atoms (e.g., methoxycarbonyl and ethoxycarbonyl), an alkylthiol group (e.g., methylthiol and ethylthiol), an acyl group (e.g., acetyl and propionyl), an alkanesulfonyl group (e.g., methanesulfonyl), a carbonamido group (e.g., N-methylcarbonamido, N,N-dimethylcarbonamido, N-ethylcarbonamido, N,N-diethylcarbonamido, N-methylolcarbonamido and N-(2-hydroxyethyl)carbonamido), a sulfonamido group (e.g., N-methylsulfonamido, N,N-dimethylsulfonamido, N-ethylsulfonamido, N,N-diethylsulfonamido, N-methylolsulfonamido and N-(2-hydroxyethyl) sulfonamido). More specifically, polybasic acids (e.g., oxalic acid, malonic acid, succinic acid, glutaric acid, glutaconic acid, adipic acid, maleic acid, acetylenedicarboxylic acid, itaconic acid, fumaric acid, muconic acid, carboxymethylmercaptopropionic acid, fluorosuccinic acid, chlorosuccinic acid, dichlorosuccinic acid, methylsuccinic acid, dimethylsuccinic acid, chloromaleic acid, dichloromaleic acid, methylmaleic acid, dimethylmaleic acid, methylmercaptomaleic acid, cyanomalonic acid, carboxymethylsuccinic acid, methoxycarbonylethylsuccinic acid, 3-methylglutaric acid, aminomethylphosphonic-N,N-diacetic acid, β-aminoethylphosphonic-N,N-diacetic acid, ethylenediaminetetrakis(methylenephosphonic acid), glycoletherdiaminetetraacetic acid, iminodiacetic acid, hexamethylenediamine-N,N,N',N'-tetraacetic acid, diaminopropanetetraacetic acid, nitrilotriacetic acid, nitrilotripropionic acid and nitrilotris(methylenephosphonic acid), oxycarboxylic acids (e.g., glycolic acid, lactic acid, hydroxyacrylic acid, oxybutyric acid, glyceric acid, tartronic acid, malic acid, tartaric acid, citric acid, gluconic acid, galactaric acid, mandelic acid, 3,4-dihydroxybutyric acid and 2-hydroxy-ethyliminodiacetic acid), aminocarboxylic acids and derivatives thereof (e.g., glycine, alanine, valine, leucine, isoleucine, serine, threonine, cysteine, cystine, methionine, aspartic acid, glutamic acid, lysine, arginine, N-(2-carboxyethylcarbamoyl)serine, aminobutyric acid, N-dihydroxyethylglycine and hydroxyethyliminodiacetic acid), thioglycolic acid, mercaptopropionic acid and 3,4-dimercaptobutyric acid, and compounds containing two or more —$PO_3H_2$ groups (for example, benzene-diphosphonic acid, and N-methylenephosphonic acid derivatives of polyamine compounds (e.g., ethylenediaminedi (methylenephosphonic acid), N-ethylethylenediaminetris (methylenephosphonic acid), propylenediaminetetrakis (methylenephosphonic acid), xylylenediaminetetrakis (methylenephosphonic acid) and 1,4-cyclohexanediaminetetrakis(methylenephosphonic acid)).

The polymer as compound (A) preferably has a molecular weight of from 500 to $1\times10^6$, and more preferably from $1\times10^3$ to $1\times10^5$. The polymer contains a polymer component having at least one acidic group selected from —$CO_2H$, —$SO_3H$ and —$PO_3H_2$ and satisfies the physical property described above. Suitable examples of the polymer component having the acidic group include vinyl compounds each having the acidic group. Such vinyl compounds are described, for example, in *Kobunshi Data Handbook (Kisohen)*, edited by The Society of Polymer Science, Japan, Baifukan (1986). Specific examples of the vinyl compound include acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, ester derivatives or amide derivatives of these carboxylic acids or sulfonic acids having the above-described acidic group in the substituent thereof, and styrene or derivatives thereof having the above-described acidic group in the substituent thereof.

It is preferred that the zinc oxide and compound (A) are dispersed together with a dispersing medium by a wet method for the formation of image receiving layer. It can be considered that a zinc ion is generated on the surface of zinc oxide grain due to an interfacial reaction with a proton, rapidly causing a chelate reaction with the compound (A), and the chelate compound which is insoluble in the dispersing medium, is rapidly precipitated and fixed on the surface of the zinc oxide grain, whereby the surface of zinc oxide grain is chemically modified to hydrophilic atmosphere.

It is also considered that the zinc oxide grains thus-chemically modified may form almost uniform aggregates dispersed in the dispersing medium and thus, an image receiving layer having the zinc oxide densely dispersed therein and an appropriate surface roughness is formed.

For example, zinc oxide grains and the compound (A) are dispersed in the dispersing medium using a wet type dispersing machine as conventionally known, and then the dispersed grains are collected by centrifuging, etc., thoroughly washed with water, and dried to obtain the desired chemically modified zinc oxide (sometimes referred to as a surface-modified zinc oxide). In such a case, a conventional dispersing agent is preferably added to the dispersion to control or enhance the dispersibility of the zinc oxide grains. The thus-obtained chemically-modified zinc oxide, a binder resin and, if desired, other additives (including unmodified zinc oxide) are subjected to wet dispersion to thereby provide a coating dispersion for the image receiving layer. Furthermore, a coating dispersion for the image receiving layer can be prepared by adding a binder resin for image receiving layer and, if desired, other additives to the dispersion of zinc oxide grains and compound (A) (without separation of the zinc oxide grains), followed by dispersing.

More preferably, a method wherein zinc oxide, a binder resin, the compound (A) and other additives are dispersed with a dispersing medium and the resulting dispersion is applied to a support, and a method wherein zinc oxide, a binder resin and other additives are dispersed with a dispersing medium and then the compound (A) is added and dispersed thereto and the resulting dispersion is applied to a support are employed in order to prepare the direct drawing type lithographic printing plate precursor according to the present invention. According to these methods, the production process is simplified and productivity is remarkably improved.

The dispersing media used in the present invention include solvents having a boiling point of not more than 200° C., preferably not more than 150° C. They are employed individually or as a mixture of two or more thereof. The solvents include water, water-soluble solvents and water-insoluble solvents. In case of using a water-insoluble solvent as the main dispersing medium, it is preferred that the compound (A) is dissolved in water or a mixed solvent of water and a water-soluble solvent to perform the treatment in a heterogeneous emulsion system.

When water is used as the main dispersing medium, the compound (A) to be employed is so elected that a chelate compound of the compound (A) formed with a zinc ion has preferably a solubility in water of not more than 15% by weight, more preferably not more than 10% by weight.

As the binding resin which can be utilized in the image receiving layer of the present invention, any binder resins as conventionally known can be used. Typical examples include vinyl chloride-vinyl acetate copolymers, styrene-butadiene copolymers, styrene-methacrylate copolymers, methacrylate copolymers, acrylate copolymers, vinyl acetate copolymers, polyvinylbutyral, alkyd resins, silicone resins, epoxy resins, epoxy ester resins, and polyester resins. Water-soluble macromolecular compounds such as polyvinyl alcohol, modified polyvinyl alcohol, starch, oxidized starch, carboxymethylcellulose, hydroxyethylcellulose, casein, gelatine, polyacrylates, polyvinyl pyrrolidone, polyvinyl ether-maleic anhydride copolymers, polyamide, and polyacrylamide may also be used as the binder resin. These resins can be used individually or as a mixture of two or more thereof.

The weight average molecular weight of binding resin to be used in the image receiving layer is preferably from $1\times^3$ to $1\times10_6$, and more preferably from $5\times10^3$ to $5\times10^5$. The glass transition temperature of binder resin is preferably from −10 to 120° C., and more preferably from 0 to 90° C.

The image receiving layer of the present invention may contain other additives, if desired. Examples of other additives include inorganic pigments other than the above described surface-modified zinc oxide. Such inorganic pigments include kaolin, clay, calcium carbonate, barium carbonate, calcium sulfate, barium sulfate, magnesium carbonate, titanium dioxide, silica, alumina, etc. When zinc oxide is used together with the surface-modified zinc oxide, the zinc oxide is preferably used in an amount of 10 to 90 parts by weight, more preferably from 20 to 80 parts by weight, per 100 parts by weight of the surface-modified zinc oxide. When the inorganic pigment other than zinc oxide is used, it can be used in an amount of not more than 20 parts by weight per 100 parts by weight of the surface-modified zinc oxide.

Further, in order to improve the desensitizing property of image receiving layer, resin grains having the specific functional group as described in JP-A-4-201387, JP-A-4-223196, JP-A-4-319491, JP-A-5-58071, JP-A-4-353495 and JP-A-5-119545 may be incorporated thereto.

These other inorganic pigments or resin grains can be used to achieve sufficient desensitization of the non-image portion to render hydrophilic, preventing background stains on resulting prints, and sufficient adhesion of the image portion onto the image receiving layer, providing prints of good image qualities without lacking of image even when the number of prints is increased.

The content of binding resin in the image receiving layer is generally from 10 to 25 parts by weight, preferably from 13 to 22 parts by weight, per 100 parts by weight of the total amount of inorganic pigment(s) (i.e., the surface-modified zinc oxide and other inorganic pigments). Within this range, the effect of the present invention is exhibited and, at the same time, high film strength during printing and high hydrophilicity during desensitization can be realized.

In the image receiving layer of the present invention, a crosslinking agent may also be contained in order to enhance the film strength. In particular, when a water-soluble resin is used as the binding resin, a crosslinking agent is preferably added to harden the image receiving layer, thereby enhancing the water resistance.

Any conventionally known crosslinking agent can be used for the purpose, such as those described, for example, in "Kakyozai Handbook (Handbook for Crosslinking Agents) ", Shinzo Yamashita and Tosuke Kaneko ed., Taiseisya -(1981), "Kobunshi Data Handbook, Kisohen (Polymer Data Handbook, Foundation)", Kobunshi Gakkai ed., Baihukan (1986).

Suitable examples include ammonium chloride, metal ions, organic peroxides, organic silane compounds (e.g., silane coupling agents such as vinyltrimethoxysilane, vinyltributoxysilane, y-glycidoxypropyltrimethoxysilane, γ-mercaptopropyltriethoxysilane, and γ-aminopropyltriethoxysilane), polyisocyanate compounds (e.g., toluidine diisocyanate, diphenylmethane diisocyanate, triphenylmethane triisocyanate, polymethylenepolyphenyl isocyanate, hexamethylene diisocyanate, isophorone diisocyanate, and high molecular weight polyisocyanates), polyol compounds (e.g., 1,4-butane diol, polyoxypropylene glycol, polyoxyethylene glycol, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., tetrabutoxy titanate, tetrachloroepoxy titanate, and isopropyltristearoyl titanate), aluminum coupling compounds (e.g., aluminum butylate, aluminum acetylacetate, aluminum oxide octate, and aluminum tris-(acetylacetate)), polyepoxy group-containing compounds and epoxy resins (e.g., compounds as described in "Shin-epokishi Jushi (New Epoxy Resins)", Hiroshi Kakiuchi ed., Shokodo (1985), "Epokishi Jushi (Epoxy Resins)", Kuniyuki Hashimoto ed., Nikkan Kogyo Shinbunsya (1969)), melamine resins (e.g., compounds described in "Yuria-Meramin Jushi (Urea-Melamine Resins)", Ichiro Miwa and Hideo Matsunaga ed., Nikkan Kogyo Shinbunsya (1969)), and poly(meth)acrylate compounds (e.g., compounds described in "Origoma (Oligomers)", Shin Ohkawara, Takeo Saegusa, Toshinobu Higashimura ed., Kodansya (1976), "Kinosei Akuriru Jushi (Functional Acrylic Resins)", Hidezo Ohmori ed., Technosystem (1985)).

In order to accelerate the crosslinking reaction in the image receiving layer, a reaction accelerator may further be added, if desired. In the case where the crosslinking reaction is a chemical-bonding reaction between functional groups, examples of the reaction accelerator include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometal compounds (e.g., acetylacetonate zirconium salt, acetylacetone zirconium salt, acetylaceto cobalt salt, and dibutoxytin dilaurate), dithiocarbamic acid compounds (e.g., diethyldithiocarbamate), thiuramdisulfide compounds (e.g., tetramethylthiuramdisulfide), carboxylic anhydrides (e.g., phthalic anhydride, maleic anhydride, succinic anhydride, butylsuccinic anhydride, 3,3',4,4'-tetracarboxylic acid benzophenone dianhydride, and trimellitic anhydride).

In the case where the crosslinking reaction is a polymerization reaction, examples of the reaction accelerator include polymerization initiators such as peroxide compounds and azobis compounds.

The binder resin is preferably photochemically and/or thermally cured after coating the coating composition of the image receiving layer. The thermal curing can be effected by setting the drying conditions for the coated layer to be severer than conventional drying conditions during formation of the image receiving layer. For example, as the drying conditions, it is preferred that a higher temperature and/or a longer period of time are applied. Alternatively, after drying the coated layer to eliminate a solvent, heat treatment is further carried out. For example, the heat treatment is conducted at 60 to 150° C. for 5 to 120 minutes. With use of the above described reaction accelerator, the heat treatment can be carried out under milder conditions.

The photochemical curing of the binder resin can be effected by exposing a functional group in the resin to a chemically active ray such as visible light, ultraviolet ray, far ultraviolet ray, electron beam, X-ray, γ-ray, and α-ray, with ultraviolet ray being preferred, particularly the ray having a wavelength of from 310 to 500 nm being more preferred. For the purpose, a low-pressure, high-pressure or ultrahigh-pressure mercury lamp or a halogen lamp is generally used. The light-exposure is conducted usually at a distance of from 5 to 50 cm for a period of 10 seconds to 10 minutes.

Now, the water-resistant support of the present invention on which the image receiving layer is provided will be described in more detail below.

The water resistant support which can be used in the present invention is characterized in that a surface adjacent to the image receiving layer is adjusted to have the Bekk smoothness of from 900 to 3,000 (second/10 cc).

Various conventionally known methods can be employed in order to control the Bekk smoothness in the above described range. Specifically, methods for controlling the Bekk smoothness of the surface of support include a melt adhesion method of resin on a surface of substrate and a calender reinforcement method using a heat roller with a highly smooth surface.

In the melt adhesion method of resin, a resin is preferably applied to a substrate by an extrusion laminating process in order to prepare a support having the desired smoothness in the present invention. The extrusion laminating process is a method wherein a molten resin is directly pressed on a substrate such as raw paper described hereinafter in the form of a film and then cooled to laminate on the substrate. Various apparatus are known for conducting the process.

The thickness of resin layer to be laminated is usually not less than 10 μm in view of production stability. A preferred range of the thickness is from 10 to 30 μm.

Suitable resins for lamination include polyethylene resins, polypropylene resins, acrylic resins, methacrylic resins, epoxy resins, and copolymers thereof. These resins can be employed individually or as a mixture of two or more thereof. Of these resins, polyethylene resins are preferred. A mixture of low density polyethylene and high density polyethylene is particularly preferred. With the use of the mixture, a uniform coating having excellent heat resistivity can be obtained. Further, the mixture provides a resin layer having excellent electric conductivity when an electrically conductive substance as described hereinafter is added.

The low density polyethylene has preferably a density of from 0.915 to 0.930 g/cc and a melt index of from 1.0 to 30 g/10 minutes. The high density polyethylene has preferably a density of from 0.940 to 0.970 g/cc and a melt index of from 1.0 to 30 g/10 minutes. A ratio of low density polyethylene and high density polyethylene in the mixture is preferably in a range of from 10/90 to 90/10 by weight.

In case of using raw paper as the substrate, prior application of a polyethylene derivative, for example, an ethylene-vinyl acetate copolymer, an ethylene-acrylic ester copolymer, an ethylene-methacrylic ester copolymer, an ethylene-acrylic acid copolymer, an ethylene-methacrylic acid copolymer, an ethylene-acrylonitrile-acrylic acid copolymer and an ethylene-acrylonitrile-methacrylic acid copolymer to the raw paper, or corona discharge treatment on the surface of raw paper is preferred in order to increase adhesion between the raw paper and the above described resin layer. Alternatively, surface treatment as described, for example, in JP-A-49-24126, JP-A-52-36176, JP-A-52-121683, JP-A-53-2612, JP-A-54-111331 and JP-B-51-25337 (the term "JP-B" as used herein means an "examined Japanese patent publication") is carried out on the raw paper.

The calender reinforcement method can be performed by calendering a substrate such as raw paper or a support having an underlayer provided on the substrate. The conditions of calendering can be appropriately selected taking the composition of substrate or underlayer, the kind and combination of rolls such as a metal roll, a resin roll or a cotton roll, the number of rolls, a nip pressure of roll and a surface temperature of roll into consideration.

In the present invention, the underlayer is provided for the purpose of increasing water resistivity of the support and adhesion between the support and the image receiving layer as described above. Also, on the surface of support opposite to the image receiving layer is provided a back-coat layer for preventing curl. The back-coat layer preferably has the Bekk smoothness in the range of from 150 to 700 (second/10 cc). By controlling the surface smoothness of back side of support, slide or slip of the resulting printing plate on an offset printing machine is prevented and thus, the printing plate can be precisely set on the printing machine.

In order to control the surface smoothness of underlayer and back-coat layer on the support in the desired ranges respectively, a step for calendering is conducted plural times. For example, calendering is carried out after the formation of underlayer and after the formation of back-coat layer calendering is again conducted. Also, the control of surface smoothness can be performed by a combination of the compositions of underlayer and back-coat layer such as an amount of pigment or a particle size of pigment and the conditions of calendering.

The substrate used for the lithographic printing plate precursor of the present invention include wood pulp paper, synthetic pulp paper, paper from admixture of wood pulp and synthetic pulp, a nonwoven fabric, a plastic film, a fabric, a metal sheet and a composite sheet thereof. Further, a coating composition comprising a hydrophilic resin, a water-dispersible or water-soluble resin and a pigment for an underlayer or back-coat layer may be impregnated to the substrate in order to obtain or adjust the desired smoothness, water resistivity and other properties.

According to the present invention, a support composed of a substrate having an underlayer and a back-coat layer provided thereon is preferably employed in order to fulfill properties required for the lithographic printing plate precursor, for example, recording characteristics, water resistivity and durability and to achieve the desired smoothness described above. The underlayer and back-coat layer is formed by means of coating and drying or laminating a composition containing a resin, a pigment and other additional components on a substrate.

The resins used for the underlayer and back-coat layer are appropriately selected from various kinds of known resins.

Specifically, these resins include hydrophobic resins, for example, acrylic resins, vinyl chloride resins, styrene resins, styrene-butadiene resins, styrene-acrylic resins, urethane resins, vinylidene chloride resins and vinyl acetate resins, and hydrophilic resins, for example, polyvinyl alcohol resins, cellulose derivatives, starch and derivatives thereof, polyacrylamide resins and styrene-maleic anhydride copolymers.

The pigment used includes clay, kaolin, talc, diatomaceous earth, calcium carbonate, aluminum hydroxide, magnesium hydroxide, titanium oxide and mica. A particle size of the pigment used is appropriately determined in order to obtain the desired smoothness as described above. Specifically, in the underlayer, pigments preferably having a particle size of not more than 8 μm, more preferably from 0.5 to 5 μm are employed since relatively high smoothness is required for the underlayer. On the other hand, pigments having rather large particle size, preferably a particle size of from 0.5 to 10 μm are employed in the back-coat layer, since lower smoothness than the underlayer is required for the back-coat layer. The pigment is preferably employed in an amount of from 80 to 150 parts by weight per 100 parts by weight of the resin in the underlayer, and in an amount of from 80 to 200 parts by weight per 100 parts by weight of the resin in the back-coat layer.

In order to obtain the excellent water resistivity, the underlayer and back-coat layer effectively contain a water-resistant agent, for example, a melamine resin and a polyamide epichlorohydrin resin.

When the direct drawing type lithographic printing plate precursor according to the present invention is used in a PPC copying machine for electrostatic transfer of toner image, it is preferred that the volume resistivity of the precursor as a whole be adjusted to a range of from $10^8$ to $10^{13}$ Ωcm, for example, by adding an electrically conductive agent to the image receiving layer, the underlayer and/or the back-coat layer, whereby background stains on the printing plate precursor can be further reduced.

The electrically conductive agent may be an inorganic or organic type, and it may be used individually or as a mixture of two or more thereof. Examples of the inorganic type include salts of monovalent metal (e.g., Na, K, and Li), salts or oxides of polyvalent metals (e.g., Mg, Ca, Ba, Zn, Ti, Co, Ni, Zr, Al, and Si), and ammonium salts. The organic type may be either a low or high molecular weight compound conventionally used as an electrically conductive agent, an antistatic agent, or a surfactant. Examples of the organic type include metallic soaps (e.g., metal salts of organic carboxylic, sulfonic, or phosphonic acids), quaternary salt compounds (e.g., quaternary ammonium salts and phosphonium salts), anion surfactants, nonion surfactants, cation surfactants, and alcohol compounds (e.g., crystalline compounds such as acetylene-1,2-diol, xylilene diol and bisphenol A).

The amount of electrically conductive agent is generally from 3 to 40% by weight, preferably from 5 to 20% by weight, of the amount of the binder used in the layer to which the electrically conductive agent is added.

The direct drawing type lithographic printing plate precursor of the present invention can be prepared as follows. Depending on the necessity, a solution for the formation of an underlayer is coated on one surface of the support and dried to form an underlayer and/or a solution for the formation of a back-coat layer is coated on the opposite surface of the support and dried to form a back-coat layer. Then, a solution for the formation of an image receiving layer is coated and dried to form an image receiving layer. The coated amount (dry basis) of each of the image receiving layer, the underlayer and the back-coat layer is preferably from 1 to 30 g/m$^2$ and more preferably from 6 to 20 g/m$^2$.

The thickness of the water-resistant support preferably having the underlayer and/or the back-coat layer is preferably in a range of from 90 to 130 $\mu$m, more preferably in a range of from 100 to 120 $\mu$m.

The printing plate precursor of the present invention produces a clear image without background stains by plate making including electrostatic transfer of toner image in a PPC copying machine. Further, the toner image formed on the printing plate precursor is firmly fixed and withstands printing pressure or tackiness of ink at offset printing, whereby cutting of toner image is prevented.

A printing plate is prepared by forming and fixing an image on the direct drawing type lithographic printing plate precursor of the present invention in a conventional manner, and then surface-treated with a desensitizing solution to render the non-image portion hydrophilic.

For the desensitization of zinc oxide contained in the image receiving layer, a cyan compound-containing desensitizing solution mainly comprising a ferrocyanate or ferrricyanate, a cyan-free desensitizing solution mainly comprising an ammine-cobalt complex, phytic acid and a derivative thereof, or a guanidine derivative, a desensitizing solution mainly comprising an inorganic or organic acid capable of forming a chelate with zinc ion, and a desensitizing solution containing a water-soluble polymer, etc. as conventionally known can be used. As the cyan compound-containing desensitizing solutions, those described, for example, in JP-B-44-9045, JP-B-46-39403, JP-A-52-76101, JP-A-57-107889 and JP-A-54-117201 are exemplified. The phytic acid compound-containing desensitizing solutions are described, for example, in JP-A-53-83807, JP-A-53-83805, JP-A-53-102102, JP-A-53-109701, JP-A-53-127003, JP-A-54-2803 and JP-A-54-44901. The desensitizing solutions containing a metal complex such as a cobalt complex are described, for example, in JP-A-53-104301, JP-A-53-140103, JP-A-54-18304, and JP-B-43-28404. As the desensitizing solutions containing an inorganic or organic acid, those described, for example, in JP-B-39-13702, JP-B-40-10308, JP-B-43-28408, JP-B-40-26124 and JP-A-51-118501 are exemplified. The guanidine-containing desensitizing solutions are described, for example, in JP-A-56-111695. As the water-soluble polymer-containing desensitizing solutions, those described, for example, in JP-A-52-126302, JP-A-52-134501, JP-A-53-49506, JP-A-53-59502, JP-A-53-104302, JP-B-38-9665, JP-B-39-22263, JP-B-40-763, JP-B-40-2202 and JP-A-49-36402 are exemplified.

During the desensitization using any of the above-described desensitizing solutions, it is believed that zinc oxide in the non-image portion of the image receiving layer is ionized to form a zinc ion which reacts with a chelate-forming compound contained in the desensitizing solution to form a zinc chelate compound which is then deposited on the surface of non-image portion, making the non-image portion hydrophilic.

The present invention will now be illustrated in greater detail with reference to the following examples, but the present invention is not to be construed as being limited thereto.

EXAMPLE 1

High quality paper having a basis weight of 100 g/m$^2$ was used as a substrate. On one surface of the substrate was coated a coating composition for underlayer shown below by a wire bar to form an underlayer having a dry coverage of 10 g/m$^2$ and a surface resistivity of $4\times10^{10}$ Ω. The smoothness of the surface of underlayer (150 second/10 cc) was controlled to 1500 (second/10 cc) by calendering.

| Coating Composition for Underlayer | |
|---|---|
| Carbon Black | 10 parts by weight |
| SBR latex (50% by weight aqueous dispersion, Tg: 25° C.) | 92 parts by weight |
| Clay (45% by weight aqueous dispersion) | 110 parts by weight |
| Melamine (80% by weight aqueous solution) | 5 parts by weight |
| Water | 191 parts by weight |

On the other surface of the substrate was coated a coating composition for back-coat layer shown below by a wire bar to form a back-coat layer having a dry coverage of 12 g/m$^2$ and a surface resistivity of $5\times10^7$ Ω. The back-coat layer was then subjected to calendering to adjust its surface smoothness to 500 (seconds/10 cc).

| Coating Composition for Back-Coat Layer | |
|---|---|
| Kaolin (50% by weight aqueous dispersion) | 200 parts by weight |
| Polyvinyl alcohol (10% by weight aqueous solution) | 60 parts by weight |
| SBR latex (49% by weight aqueous dispersion, Tg: 0° C.) | 100 parts by weight |
| Precondensate of melamine resin (Sumirez Resin SR-613, solid basis: 80% by weight) | 5 parts by weight |

A mixture of 200 g of dry-type zinc oxide (manufactured by Seido Kagaku Kogyo K.K.), 27 g of Binder Resin (B-1) shown below, 3.0 g of Binder Resin (B-2) shown below and 310 g of toluene was dispersed using a Keddy mill (KDM7-4 Model, manufactured by Rigaku Kogyo K.K.) at a rotation of $1\times10^4$ r.p.m. for 30 minutes. To the dispersion was added a mixture of 11.0 g of a 50% by weight aqueous solution of phytic acid (Compound (A-1)) and 27 g of methanol, followed by dispersion at a rotation of $5\times10^3$ r.p.m. for 20 minutes to prepare a composition for an image receiving layer.

Binder Resin (B-1)

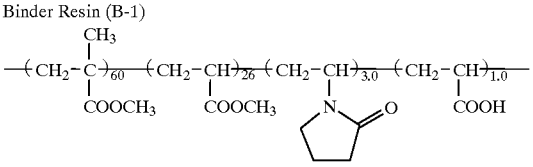

Mw $5\times10^4$ (weight ratio)

Binder Resin (B-2)

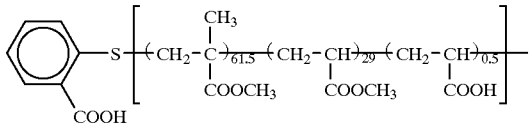

Mw $8\times10^3$ (weight ratio)

The composition for image forming layer was coated on the support prepared as described by a wire bar and dried at 100° C. for 1 minute to form an image receiving layer having a dry coverage of 10 g/m$^2$ whereby a direct drawing type lithographic printing plate precursor was prepared.

Comparative Example 1

A direct drawing type lithographic printing plate precursor was prepared in the same manner as in Example 1, except for omitting Compound (A-1). The surface of resulting image receiving layer was adjusted by appropriately controlling the condition of dispersion to have the Bekk smoothness equivalent to that of the surface of the image receiving layer of Example 1.

Comparative Example 2

A direct drawing type lithographic printing plate precursor was prepared in the same manner as in Example 1, except for omitting the calendering after the formation of underlayer and instead conducing calendering to adjust surface smoothness of underlayer to 600 (seconds/10 cc) after the formation of back-coat layer.

Using each of the printing plate precursors prepared in Example 1 and Comparative Examples 1 and 2, a printing plate was produced by forming an image onto the image receiving layer of the printing plate precursor by a dry toner type laser printer, and desensitizing the precursor. Then, printing was conducted using the thus produced printing plate.

The surface characteristics of the image receiving layer of each of the printing plate precursors before plate-making and the image of print produced using the resulting printing plate were examined, and the results as shown in

TABLE 1

| | Example 1 | Comparative Example 1 | Comparative Example 2 |
|---|---|---|---|
| Smoothness of underlayer of support: (sec./10 cc)*1 | 1500 | 1500 | 600 |

TABLE 1-continued

| | Example 1 | Comparative Example 1 | Comparative Example 2 |
|---|---|---|---|
| Characteristics of image receiving layer: | | | |
| Smoothness (sec./10 cc)*1 | 45 | 50 | 46 |
| Three-dimensional surface roughness Ra (μm)/λa (μm)*2 | 1.63/40.3 | 1.78/90.0 | 1.65/41.0 |
| Image of print:*3 | | | |
| Image quality | Good (No cutting of fine lines and letters, uniform density on solid portion) | Poor (No cutting of fine lines and letters, unevenness density on solid portion) | Poor (Cutting of fine lines and letters, unevenness in density on solid portion) |
| Stains in non-image portion | Good (Slight background stains) | Poor (Remarkable background stains) | Good (Slight background stains) |

Note:

1)Smoothness of Underlayer or Image Receiving Layer

The Bekk smoothness (second/10 cc) was measured using a Bekk smoothness tester (manufactured by Kumagaya Riko K.K.) under the condition of air volume of 10 cc.

2)Three-dimensional Surface Roughness

The three-dimensional surface roughness was measured using a three-dimensional surface roughness measuring device (SE-3FK, manufactured by Kosaka Laboratory Ltd.) and a three-dimensional surface roughness analyzer (SPA-11, manufactured by Kosaka Laboratory Ltd.) under the following conditions:

Measuring conditions:

Measuring length: X axis: 2.5 mm, Y axis: 0.4 mm

Axis sampling pitch: 0.05 μm

Inclined adjustment, no cutting-off

Measured values:

Average surface center roughness: SRa (μm)

Average wavelength: Sλa (μm)

Three measurements were performed according to the standard of ISO-468. In detail, a reference can be made, for example, to Jiro Nara, "Hyomen-Arasa no Sokutei.Hyokahou (Measurement and Evaluation of Surface Roughness)", Sogou Gijutsu Center (1983).

3)Image of Print

After an image was formed on the precursor by a dry toner-type laser printer commercially available as AM-Straight Imaging System (AMSIS 120-J Plate Setter, manufactured by Nippon AM Co.), the precursor was fed into a full automatic printing machine (AM-2850, manufactured by Nippon AM Co.) wherein a desensitizing solution (SICS, manufactured by Nippon AM Co.) was charged in its etcher portion and a dampening solution which had been prepared by diluting thedesensitizing solution (SICS) four times with distilled water was charged in its dampening portion, and offset printing was conducted using black ink. The image of the 10th print was visually evaluated using a magnifying glass of 20 magnifications with respect to background stains and uniformity in density of solid portion of the image.

As shown in Table 1, the image receiving layers of the printing late precursors of Example 1 and Comparative Examples 1 and 2 exhibited almost the same Bekk smoothness.

Further, it was found from the results of the surface roughness of the printing plate precursors of Example 1 and Comparative Example 1 wherein the image receiving layer was different from each other with respect to SRa (average surface center roughness which implies the magnitude of the surface roughness) and Sλa (average wavelength which implies the density of the roughness), that both precursors had almost the same SRa values, but exhibited remarkably different Sλa values from each other. Specifically, the precursor of Example 1 had roughness formed more densely as compared with the precursor of Comparative Example 1, while both exhibited substantially the same Bekk smoothness. In the precursor of Comparative Example 1 which did not contain Compound (A-1) capable of forming a chelate compound, coarse grains are sparsely present on the surface of image receiving layer thereof.

It is also seen that only the printing plate resulted from the printing plate precursor of the present invention which had been subjected to plate-making and desensitization attained good image qualities with respect to both the image formed on the image receiving layer and the image on prints.

More specifically, the image formed on the precursor of the present invention by transfer of any toner using the laser printer had no cutting of fine lines and fine letters and had uniform image density in solid portion, showing no uneven transfer of toner, and the non-image portion had slight background fogs due to scattering of toner which had no problem in practical use.

In contrast, the printing plate precursor of Comparative Example 1 which did not contain Compound (A-1) was insufficient for practical use because the image formed on the image receiving layer had remarkable unevenness in the image portion and increased background fog in the non-image portion.

In the image formed on the printing plate precursor of Comparative Example 2 comprising the support having the underlayer of low smoothness, background fogs due to scattering of toner was slight and equivalent to the image on the precursor of Example 1. However, slight lack of toner occurred in solid portion was observed, while cutting of fine lines and fine letters was not observed. It is believed that such defect resulted from unevenness occurred during the steps of electrostatic transfer of toner from a photoreceptor and fixing of heat roller type in the portion where surface roughness of the underlayer of support and surface roughness of the image receiving layer acted synergistically.

Further, only the printing plate precursor of the present invention provided more than 3,000 good prints having the image without cutting of fine lines and fine letters and unevenness in density in solid portion, and having slight background ink stains in the non-image portion which had no problem in practical use.

On the contrary, with the printing plate of Comparative Example 1, background stains in the non-image portion occurred from the start of printing and continued to occur after printing 3,000 prints. With the printing plate of Comparative Example 2, unevenness in density in solid portion occurred in prints.

From these results, it is considered that the characteristics of the image receiving layer which are influenced by the zinc oxide grains incorporated therein and the smoothness of surface of support adjacent to the image receiving layer closely relate with the qualities of image formed on printing plate precursor and prints. Specifically, the printing plate precursor comprising the support having a highly smooth surface provided thereon the image receiving layer in which distribution of zinc oxide is comparatively uniform and which has the surface of dense roughness according to the present invention has excellent properties.

It is also seen from the results of the three-dimensional roughness that the printing plate precursor of the present invention has roughness more densely as compared with that of Comparative Example 1 while these precursors have almost the same Bekk smoothness. Furthermore, when the background stains in the non-image portion after plate-making were observed by an optical microscope of 200 magnifications, the number of the toner portion constituting the background stains was 15 per unit area (1 $mm^2$) and was the same between those of Example 1 and Comparative Example 1, but the number of the toner portion having a size of 15 $\mu$m or more was 0 or 1 in Example 1, whereas it was 4 or 5 in Comparative Example 1. The background stains due to toner on the printing plate precursor of Comparative Example 2 which has the same image receiving layer as in Example 1 was on a level with Example 1.

From these facts, it is considered that plate-making using the printing plate precursor of the present invention is kept from adhesion of scattered toner on the non-image portion and from spreading of toner particles upon fixing with a heat roller, resulting in slight background stains. It is also considered that the difference in degree of background stains on print corresponds to the size of scattered toner portions on the image receiving layer of printing plate precursor which is large enough to remain even after desensitization and cause stains, while scattered toner portions of less than 15 $\mu$m in size are rendered hydrophilic upon desensitization and cause no stains. Since the surface of the hydrophobic zinc oxide is modified to have enhanced hydrophilicity in the present invention, the hydrophilicity of the image receiving layer is increased due to the presence of the modified zinc oxide therein so that the wettability to the desensitizing solution is markedly improved and the small portions of scattered toner can be rendered hydrophilic sufficiently even under rapid desensitization.

For the reasons described above, only the printing plate precursor of the present invention can provide good prints.

EXAMPLE 2

A mixture of 100 g of dry-type zinc oxide (SAZEX-2000, manufactured by Sakai Chemical Industry Co., Ltd.), 1 g of a dispersing agent (Carvone L-400, manufactured by Sanyo Chemical Industries, Ltd.), and 15.0 g of an aqueous solution containing 3 g of phytic acid dissolved therein whose pH had been adjusted to 4.0 with an aqueous ammonia was dispersed with 20 g of glass beads having a diameter of 0.7 to 1 mm by a Dynomill dispersing machine at a rotation of $3\times10^3$ r.p.m. for 30 minutes, and then the glass beads were removed by filtration.

To the dispersion was added 15 g (solid basis) of an acrylate emulsion (AE932, manufactured by Japan Synthetic Rubber Co., Ltd.) as a binder resin, and the mixture was dispersed with a homogenizer at a rotation of $1\times10^3$ r.p.m. for 1 minute to prepare a coating composition for an image receiving layer.

The coating composition was coated on the support described in Example 1 by a wire bar, dried at 80° C. for 1 minute to provide an image receiving layer having a dry coverage of 10 $g/m^2$ and the Bekk smoothness of 55 (seconds/10 cc).

The printing plate precursor thus prepared was subjected to plate-making and desensitization in the same manner as in Example 1 to obtain a printing plate. When an offset printing was conducted using the printing plate as in Example 1, more than 3,000 prints having a clear image without stains in the non-image portion as in Example 1 were obtained.

Even when plate-making was conducted by way of a thermal transfer printer (Write Movell, produced by Kanto Electronics Co., Ltd.) instead of the laser printer, the resulting image formed on the precursor had little ink transfer from an ink ribbon in the non-image portion, causing no problem in practical use. After the desensitization of the precursor with SICS as described above, the resulting printing plate provided, upon offset printing, more than 1,000 prints having good image quality without cutting of fine lines and fine letters and only slight stains in the non-image portion which were still acceptable in practical use.

EXAMPLE 3

On high quality paper having a basis weight of 95 g/m$^2$ was coated a 5% by weight aqueous solution of calcium chloride at a dry coverage of 20 g/m$^2$, followed by drying to obtain electrically conductive paper. On both surfaces of paper was coated an aqueous latex of ethylene/methyl acrylate/acrylic acid (65/30/5 in molar ratio) copolymer at a dry coverage of 0.2 g/m$^2$ and dried. On one surface of the substrate was provided a uniform polyethylene layer having a thickness of 25 $\mu$m and a surface resistivity of $6\times10^9$ Ω by an extrusion laminating process using pellets produced by melting and kneading a mixture of 70 parts by weight of low density polyethylene having a density of 0.920 g/cc and a melt index of 5.0 g/10 minutes, 15 parts by weight of high density polyethylene having a density of 0.950 g/cc and a melt index of 8.0 g/10 minutes and 15 parts by weight of electrically conductive carbon. The polyethylene layer was then subjected to calendering to adjust its surface smoothness to 2000 (seconds/10 cc).

On the other surface of the substrate was coated a coating composition for back-coat layer shown below by a wire bar to form a back-coat layer having a dry coverage of 20 g/m$^2$ and a surface resistivity of $8\times10^7$Ω. The back-coat layer was subjected to calendering to adjust its surface smoothness to 450 (second/10 cc).

| Coating Composition for Back-Coat Layer | |
|---|---|
| Clay (50% by weight aqueous dispersion) | 200 parts by weight |
| Oxidized starch (20% by weight aqueous solution) | 40 parts by weight |
| SBR latex (49% by weight aqueous dispersion, Tg: 10° C.) | 150 parts by weight |
| Precondensate of melamine resin (Sumirez Resin SR-613, solid basis: 80% by weight) | 10 parts by weight |

The surface of polyethylene layer was treated with corona discharge under the condition of 5 KVA·sec/m$^2$, and then a coating composition for image receiving layer shown below was coated at a dry coverage of 8 g/m$^2$ and dried to form an image receiving layer. The surface thereof had the Bekk smoothness of 50 (seconds/10 cc).

Coating Composition for Image Receiving Layer

A mixture of 100 g of wet-type zinc oxide ("AZO" produced by Seidou Kagaku Kogyo K.K.), 1.5 g (solid basis) of a dispersing agent (Demol EP, manufactured by Kao Corporation) and 150 g of an aqueous solution containing 4 g of oxalic acid (Compound (A-2)) dissolved therein whose pH had been adjusted to 3.0 with an aqueous ammonia was dispersed with 150 g of glass beads having a diameter of 0.7 to 1 mm using a Dynomill dispersing machine at a rotation of $6\times10^3$ r.p.m. for 15 minutes, and then the glass beads were removed by filtration.

The dispersion was subjected to centrifugal separation, and the precipitate was collected, thoroughly washed with water, and dried under a reduced pressure to obtain 90 g of solid powder.

A mixture of 60 g of the zinc oxide powder prepared above, 40 g of zinc oxide (AZO), 1.2 g (solid basis) of Demol EP and 150 g of water was dispersed together with 150 g of glass beads having a diameter of 0.7 to 1 mm by a Dynomill dispersing machine at a rotation of $3\times10^3$ r.p.m. for 30 minutes. Thereafter, the glass beads were removed by filtration, and 15 g (solid basis) of an acrylate emulsion (Cevian-A46488, manufactured by Daicel Chemical Industries, Ltd.) was added thereto, and the mixture was stirred by a stirrer at a rotation of $1\times10^3$ r.p.m. for 1 minute to prepare a coating composition for an image receiving layer.

The resulting printing plate precursor was subjected to plate-making and desensitization in the same manner as in Example 1 to obtain a printing plate. When an offset printing was conducted using the printing plate as in Example 1, more than 5,000 prints having a clear image without stains in the non-image portion as in Example 1 were obtained.

Comparative Example 3

A direct drawing type lithographic printing plate precursor was prepared in the same manner as in Example 3, except for conducting calendering to adjust surface smoothness of underlayer to 600 (seconds/10 cc) after the formation of underlayer.

With the image on the printing plate precursor formed by the plate-making in the same manner as in Example 3, the image quality was poorer than that of Example 3 since unevenness in image density slightly occurred in solid portion while background fogs due to scattering of toner in the non-image portion was on a level with Example 3.

The printing plate precursor was subjected to desensitization and printing was conducted using the resulting printing plate in the same manner as in Example 3. Uniformity in solid portion was poor on prints obtained since unevenness was observed in the solid portion.

EXAMPLES 4 TO 15

Each direct drawing type lithographic printing plate precursor was prepared in the same manner as in Example 1, except for using each of the compounds shown in Table 2 below in place of phytic acid (Compound (A-1)). The Bekk smoothness of the surface of each printing plate precursor was in a range of from 50 to 60 (second/10 cc).

Each printing plate precursor was subjected to plate-making and desensitization in the same manner as in Example 1 to obtain a printing plate. When an offset printing was conducted using the printing plate as in Example 1, more than 3,000 prints having a clear image without stains in the non-image portion as in Example 1 were obtained.

TABLE 2

| Example | Compound (A) | | |
|---|---|---|---|
| 4 | Polyacrylic acid ($\overline{M}$w $3\times10^3$) | (A-3) | 5 g |
| 5 | Aminomethylphosphonic-N,N-diacetic acid ($\overline{M}$w 241) | (A-4) | 3.5 g |
| 6 | Polyvinylphosphonic acid (Mw $5\times10^3$) | (A-5) | 4 g |
| 7 | Ethylenediaminetetrakis(methylene-phosphonic acid) ($\overline{M}$w 484) | (A-6) | 4.4 g |
| 8 | Acetylenedicarboxylic acid ($\overline{M}$w 114) | (A-7) | 2 g |

TABLE 2-continued

| Example | Compound (A) | | |
|---|---|---|---|
| 9 | Tartoronic acid ($\overline{M}$w 120)<br>Asparatic acid ($\overline{M}$w 133) | (A-8)<br>(A-9) | 1.5 g<br>1.0 g |
| 10 | 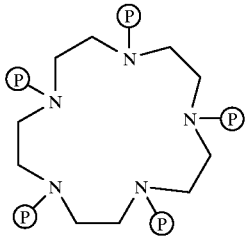 | (A-10) | ($\overline{M}$w 745)<br>3.8 g |
| 11 | 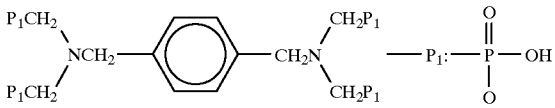 | (A11) | ($\overline{M}$w 546)<br>3 g |
| 12 | 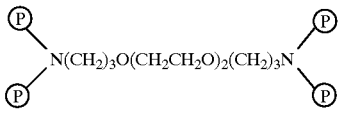 | (A-12) | ($\overline{M}$w 644)<br>4 g |
| 13 | 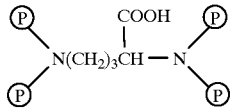 | (A-13) | ($\overline{M}$w 556)<br>3.5 g |
| 14 | Ethylenediaminetetraacetic acid<br>($\overline{M}$w 292.25) | (A-14) | 4.5 g |
| 15 | 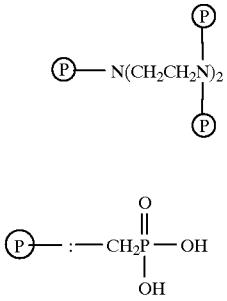 | (A-15) | ($\overline{M}$w 633)<br>3 g |

EXAMPLE 16

A mixture of 100 g of the surface-modified zinc oxide powder prepared in Example 3, 14 g of Binder Resin (B-3) shown below, 1.5 g (solid basis) of an acrylic acid resin dispersion shown below and 230 g of toluene was dispersed by a homogenizer at a rotation of $1\times10^4$ r.p.m. for 20 minutes to prepare a coating composition for an image receiving layer.

Binder Resin (B-3)

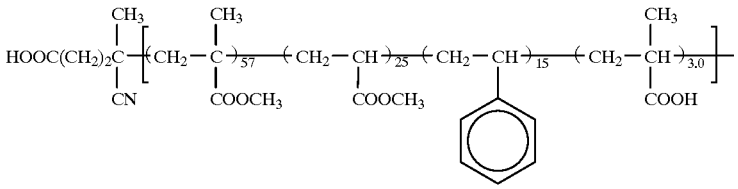

Mw $5x10^4$ (weight ratio)

Acrylic Acid Grain Dispersion

A mixture of 8 g of acrylic acid, 2 g of a methyl methacrylate macromonomer (AA-6 manufactured by Toagosei Chemical Industry Co., Ltd.), 2 g of ethylene glycol dimethacrylate, 0.1 g of methyl 3-mercaptopropionate and 55 g of methyl ethyl ketone was heated to a temperature of 60° C. under nitrogen gas stream while stirring. To the mixture was added 0.2 g of 2,2'-azobis(isovaleronitrile) (abbreviated as AIVN), followed by reacting for 3 hours. To the reaction mixture was further added 0.1 g of AIVN, followed by reacting for 4 hours. The resulting dispersion had good monodispersity with a reaction rate of 95%, and an average grain diameter of the resin grain dispersed therein measured by CAPA-500 manufactured by Horiba Ltd. was 0.20 $\mu$m.

The coating composition was coated on the support described in Example 1 by a wire bar, dried at 100° C. for one minute to form an image receiving layer having a dry coverage of 8 g/$m^2$ and the Bekk smoothness of 65 (seconds/10 cc).

The resulting printing plate precursor was subjected to plate-making and desensitization in the same manner as in Example 1 to obtain a printing plate. When offset printing was conducted using the printing plate as in Example 1, more than 3,000 prints having a clear image without stains in the non-image portion as in Example 1 were obtained.

The image receiving layer according to the present invention preferably contains zinc oxide grains obtained by wet-type dispersion of zinc oxide together with a water-soluable organic compound having at least one acidic group selected from —$CO_2H$, —$SO_3H$ and —$PO_3H_2$ capable of forming a chelate compound with a zinc ion. The zinc oxide grains thus-chemically modified may form almost uniform aggregates dispersed in the dispersing medium and thus, the image receiving layer having the zinc oxide densely dispersed therein and an appropriate surface roughness is formed. As a result, the surface of image receiving layer can be easily controlled to have the desired smoothness.

Further, the water-resistant support according to the present invention has a surface adjacent to the image receiving layer having the Bekk smoothness of from 900 to 3,000 (seconds/10 cc). Therefore, the image receiving layer is firmly held while maintaining the controlled surface structure, whereby image qualities are further improved.

As described above, the surface of image receiving layer of the direct drawing type lithographic printing precursor of the present invention is preferably controlled to have the desired smoothness. Thus, fogs in the non-image portion due to scattering of toner are depressed to a level which does not cause problem in practical use and toner is uniformly and sufficiently adhered in the image portion by plate-making. Therefore, when printing is conducted using a printing plate which is finally obtained by the desensitizing treatment of the image-bearing printing plate precursor, good prints having the image portion excellent in reproducibility of fine lines and fine letters and uniformity in density of the solid image part and little background stains which do not cause problems in practice can be obtained.

The direct drawing type lithographic printing plate precursor according to the present invention is excellent in image reproducibility and prevention of background stains in the non-image portion by drawing an image through electrostatic transfer of a toner image onto its image receiving layer by way of a laser printer, etc., so as to provide prints having a clear image without stains. Moreover, it exhibits an excellent desensitizing property and provides a printing plate not only free from background stains over an entire surface but also free from dot-like stains. Furthermore, the precursor can produce prints having a clear image without stains even when it is subjected to electrostatic transfer of a toner image formed by an electrophotographic copying machine in plate-making.

While the invention has been described in detail and with reference to specific embodiments thereof, it will be apparent to one skilled in the art that various changes and modifications can be made therein without departing from the spirit and scope thereof.

What is claimed is:

1. A direct drawing lithographic printing plate precursor comprising a water-resistant support and an image receiving layer provided thereon, wherein a surface of the water-resistant support has the Bekk smoothness in the range of from 900 to 3,000 second per 10 cc and the image receiving layer contains zinc oxide dispersed in the presence of water, a binder resin and a water-soluble organic compound having at least one acidic group selected from —$CO_2H$, —$SO_3H$ and —$PO_3H_2$, which forms a chelate compound with the zinc oxide or a zinc ion formed from the zinc oxide.

2. A direct drawing lithographic printing plate precursor as claimed in claim 1, wherein a content of the water-soluble organic compound is from $1.0\times10^{-4}$ to $1.0\times10^{-1}$ mol per 100 g of zinc oxide.

3. A direct drawing lithographic printing plate precursor as claimed in claim 1, wherein a surface of the image receiving layer has the Bekk smoothness of from 25 to 100 second per 10 cc.

4. A direct drawing lithographic printing plate precursor as claimed in claim 1, wherein the image receiving layer has an average surface center roughness, Sra, defined in ISO-468 of from 1.3 to 3.5 $\mu$m and an average wavelength, S$\lambda$a, of not more than 50 $\mu$m.

5. A direct drawing lithographic printing plate precursor as claimed in claim 1, wherein the water-soluble organic compound has a solubility of at least 0.5% by weight in water.

6. A direct drawing lithographic printing plate precursor as claimed in claim 1, wherein the lithographic printing plate precursor has a volume resistivity of from $10^8$ to $10^{13}$ $\Omega$cm.

* * * * *